US010597923B2

(12) United States Patent
Intelmann et al.

(10) Patent No.: US 10,597,923 B2
(45) Date of Patent: Mar. 24, 2020

(54) STOP POSITION DAMPING DEVICE AND ARRANGEMENT WITH STOP POSITION DAMPING DEVICE

(71) Applicant: HAHN-Gasfedern GmbH, Aichwald (DE)

(72) Inventors: Hans Christof Intelmann, Weissach (DE); Hubert Redle, Wernau (DE)

(73) Assignee: HAHN-Gasfedern GmbH, Aichwald (DE)

( * ) Notice: Subject to any disclaimer, the term of this patent is extended or adjusted under 35 U.S.C. 154(b) by 0 days.

(21) Appl. No.: 16/015,383

(22) Filed: Jun. 22, 2018

(65) Prior Publication Data

US 2018/0371815 A1 Dec. 27, 2018

(30) Foreign Application Priority Data

Jun. 22, 2017 (DE) ..... 10 2017 113 862

(51) Int. Cl.
*E05F 1/08* (2006.01)
*E05F 3/02* (2006.01)
*E05F 5/00* (2017.01)

(52) U.S. Cl.
CPC ..... *E05F 3/02* (2013.01); *E05F 5/00* (2013.01); *E05F 5/003* (2013.01);
(Continued)

(58) Field of Classification Search
CPC ..... E05F 5/00; E05F 5/003; E05F 5/02; E05F 5/05; E05F 1/08; E05F 1/1091;
(Continued)

(56) References Cited

U.S. PATENT DOCUMENTS

2010/0007254 A1* 1/2010 Zimmer ..... E05F 1/16 312/333
2010/0123378 A1* 5/2010 Chen ..... A47B 88/467 312/333

(Continued)

FOREIGN PATENT DOCUMENTS

DE 202014009249 U1 12/2014
EP 3108081 B1 * 2/2018 ..... E05F 5/003

(Continued)

*Primary Examiner* — Chuck Y Mah
(74) *Attorney, Agent, or Firm* — Fitch, Even, Tabin & Flannery LLP

(57) ABSTRACT

A stop position damping device (13) for a sliding element (11) that is slidably arranged in a sliding direction (R) relative to a stationary element (12) includes a structural unit (14) and an activating part (15) that are connected to one of the two elements (11), (12) respectively. The structural unit (14) has a base carrier (21) at which a damping cylinder supporting arrangement (23) is pivotably mounted with one and around a first pivot axis (S1). At the opposite free end (24), the damping cylinder supporting arrangement (23) is supported without guidance at the base carrier (21) via a biasing element (25), wherein the biasing element (25) creates a torque around the first pivot axis (S1). In an area that is closer to the free end (24) as to the first pivot axis (S1), a catch part (45) can move in a length direction (L) relative to the damping cylinder supporting arrangement (23). If an unintended collision occurs between the activating part (15) and the catch part (45), the damping cylinder supporting arrangement (23) with the catch part (45) can pivot away from the activating part (15).

15 Claims, 4 Drawing Sheets

(52) U.S. Cl.
CPC ..... *E05Y 2201/21* (2013.01); *E05Y 2201/478* (2013.01); *E05Y 2600/13* (2013.01); *E05Y 2600/31* (2013.01); *E05Y 2600/46* (2013.01); *E05Y 2900/132* (2013.01); *E05Y 2900/148* (2013.01)

(58) Field of Classification Search
CPC ..... E05F 1/16; E05F 3/00; E05F 3/02; E05F 3/04; E05F 3/18; E05F 3/227; E05F 3/22; E05F 3/224; E05F 3/10; E05F 3/108; E05Y 2800/24; E05Y 2800/21; E05Y 2201/64; E05Y 2201/644; E05Y 2201/264; E05Y 2201/41; E05Y 2201/412; E05Y 2201/47; E05Y 2201/478; E05Y 2201/21; E05Y 2201/488; E05Y 2900/132; E05Y 2900/142; E05Y 2900/14; E05Y 2201/232; E05Y 2201/426; E05Y 2201/638; E05Y 2800/11; E05Y 2600/13; E05Y 2600/31; E05Y 2600/46; E05Y 2900/148; E05Y 2201/688; A47B 88/047; A47B 88/12; A47B 88/14; A47B 2210/0091; A47B 88/426; A47B 88/638; A47B 2800/11; A47B 88/31; A47B 2900/132; A47B 88/148; Y10T 16/27; Y10T 16/56; Y10T 16/61; Y10T 16/593; Y10T 16/276; Y10T 16/281; Y10T 16/379; E05D 15/00; E05D 15/06; E05D 15/12
See application file for complete search history.

(56) References Cited

U.S. PATENT DOCUMENTS

2011/0017191 A1* 1/2011 White ..... E05F 1/1261 126/198
2011/0023370 A1* 2/2011 Zimmer ..... E05F 1/16 49/360
2011/0080080 A1* 4/2011 Zimmer ..... A47B 88/467 312/319.1
2011/0167588 A1* 7/2011 Chang ..... E05F 5/003 16/71
2011/0215690 A1* 9/2011 Juan ..... A47B 88/483 312/319.1
2013/0076219 A1* 3/2013 Lam ..... A47B 88/487 312/319.1
2013/0312217 A1* 11/2013 Kleeman ..... A47L 15/4261 16/54
2014/0026357 A1* 1/2014 Zimmer ..... E05F 1/16 16/72
2014/0109343 A1* 4/2014 Chang ..... E05F 5/003 16/49
2016/0333622 A1* 11/2016 Glogowski ..... E05F 5/003
2016/0340955 A1* 11/2016 Zimmer ..... E05F 5/003

FOREIGN PATENT DOCUMENTS

JP 2006063767 A * 3/2006 ..... E05F 1/16
JP 2008223456 A * 9/2008 ..... E05F 1/16
JP 2008308968 A * 12/2008
JP 5305124 B2 * 10/2013

* cited by examiner

STOP POSITION DAMPING DEVICE AND ARRANGEMENT WITH STOP POSITION DAMPING DEVICE

RELATED APPLICATION(S)

This application claims the benefit of German Patent Application No. 10 2017 113 862.5, filed Jun. 22, 2017, the contents of which is incorporated herein by reference as if fully rewritten herein.

TECHNICAL FIELD

The invention refers to a stop position damping device for a sliding element that is slidably supported relative to a stationary element. The stop position damping device operates in a movement range following the completely closed position of the sliding element in relation to the stationary element. In this movement range the stop position damping device damps the closing movement between the sliding element and the stationary element and can create a defined closing movement or closing force respectively.

BACKGROUND

Such a stop position damping device is known from DE 20 2014 009 249 U1 for example. This stop position damping device has a damping cylinder with a first end and a second end. The damping cylinder is supported within a damping cylinder supporting arrangement. The damping cylinder supporting arrangement is slidably arranged at bearing bodies in the height direction and spring biased in height direction. At the side facing in the biasing direction, the damping cylinder supporting arrangement has rolls, with which it is in contact at an abutment surface of the stationary element. The biasing force is responsible that a continuous contact of the rolls with the stationary element is maintained in a using condition. The damping cylinder supporting arrangement can be disposed between the frame and the wing of a door or a window, for example. Due to the spring bias, the damping cylinder supporting arrangement is biased away from the wing against the frame. Thus, the damping cylinder supporting arrangement is able to move in height direction relative to the wing and the frame and can adopt a defined working position upon contact of the rolls at the abutment surface of the frame.

Such a height adjustment that slidably supports the damping cylinder supporting arrangement in height direction and that is adjustable during operation is elaborate and thus expensive. The mounting requires handling of many separate parts.

Known stop position damping devices may involve mistakes during mounting that may result in damage during subsequent start-up. It is an object of the present invention to provide a stop position damping device of which the mounting is easy and a mounting fault does not result in damage of the stop position damping device.

SUMMARY

The stop position damping device is configured to affect a relative movement following a closing position between a sliding element and a stationary element that are slidably supported in a sliding direction relative to each other. Particularly, the movement of the sliding element in the closing position shall be damped and/or shall be executed with a defined closing force.

The stop position damping device therefore contains a damping cylinder with a first end and a second end. The two ends are moveably relative to each other in a length direction of the damping cylinder. At the first end a catch part is arranged that is configured to cooperate with an activating part. The damping cylinder with the catch part is therefore arranged at the sliding element or at the stationary element, whereas the activating part is fixed to the respective other element, that is to the stationary element or the sliding element respectively.

The damping cylinder is mounted to a damping cylinder supporting arrangement. This damping cylinder supporting arrangement is connectable or connected with a base carrier by means of a first pivot bearing. Preferably, the base carrier and the damping cylinder supporting arrangement form one structural unit that can be handled unitarily during mounting at the sliding element or the stationary element respectively. The first pivot bearing defines a first pivot axis that extends in a transverse direction perpendicular to the length direction.

On the side opposite to the first pivot bearing the damping cylinder supporting arrangement comprises a free end. There, the damping cylinder supporting arrangement is supported by means of a biasing element at the base carrier and is biased away from the base carrier by means of the biasing element. The biasing element thus creates a torque on the total damping cylinder supporting arrangement around the first pivot axis.

Thus the damping cylinder and the damping cylinder supporting arrangement can execute a collective pivot movement around the first pivot axis away from the activating part or toward the activating part. If the stop position damping device is not in a defined initial condition during assembly and particularly a predefined initial relative position between the catch part and the activating part is not present, a collision may occur between the activating part and the catch part at a location of the catch part not provided for normal operation and it may therefore cause damage, particularly at the catch part. According to the invention, damage at the first operation after the assembly due to the occurrence of such a collision can be avoided by the pivot bearing of the stop position damping device. The damping cylinder supporting arrangement with the damping cylinder and the catch part can pivot away from the activating part as one common unit against the force or against the torque of the biasing element and can particularly avoid damage at the catch part. By pivoting back again toward the activating part, the catch part and the activating part subsequently assume a defined intended position and the stop position damping device can subsequently operate as intended.

Preferably the stop position damping device has only one single rotative degree of freedom about the first pivot axis relative to the base carrier. Additional degrees of freedom are not present apart from a technically necessary clearance. During operation the first pivot axis has a defined relative orientation with regard to the base carrier that does not change.

The first pivot bearing is particularly the only guide with which the damping cylinder supporting arrangement is moveably guided relative to the base carrier. Particularly, the free end of the damping cylinder supporting arrangement is implemented without guidance. The biasing element creates in this case only a biasing force or a torque around the first pivot axis without providing movement guidance.

The damping cylinder supporting arrangement can be carried out in different forms. For example it can comprise a carrier framework and/or at least one carrier plate. In one embodiment two connected carrier plates are present between which the damping cylinder is arranged. The cylinder housing is particularly non-moveably attached at the damping cylinder carrier arrangement and for example between the carrier plates—apart from a technically necessary clearance.

In one embodiment the base carrier can comprise a base plate that extends in the sliding direction from the first end to the second end of the damping cylinder supporting arrangement with distance to the damping cylinder and/or the damping cylinder supporting arrangement. At the base plate the biasing element can be supported in the area of the first end of the damping cylinder supporting arrangement. In one embodiment a bearing body that carries the first pivot bearing or that defines a portion of the first pivot bearing, can be attached to the base plate.

In one embodiment the height distance of the first pivot axis from the base plate is unmodified predefined at least after the assembly during the operation of the stop position damping device or in each condition. In an alternative embodiment an adjustment device may be present for adjusting the height distance between the first pivot axis and the base plate. For example, an adjusting screw can be present at the bearing body.

It is also advantageous if the damping cylinder comprises a cylinder housing, a piston slidably arranged in length direction in the cylinder housing and a piston rod connected with the piston. A piston rod end of the piston rod may extend out of the cylinder housing and may define the first end of the damping cylinder. In such a design the second end of the damping cylinder is present at the cylinder housing.

The damping cylinder can be implemented as gas pressure spring for example.

It is also advantageous that the cylinder housing is unmovably held relative to the damping cylinder supporting arrangement. Particularly, the cylinder housing may not execute a pivot movement and/or a linear movement relative to the damping cylinder supporting arrangement, apart from a technically necessary clearance of the mount. The orientation of the damping cylinder is thus defined by the orientation of the damping cylinder supporting arrangement and particularly its pivot position around the first pivot axis.

In an advantageous embodiment the catch part is pivotably supported at the piston rod around a second pivot axis extending in transverse direction by means of a second pivot bearing. The catch part can assume different pivot positions around the second pivot axis depending from whether the stop position damping device is in a tensioned position or out off the tensioned position.

It is advantageous that the catch part comprises a guide element that is arranged with distance to the second pivot axis. The guide element can be particularly formed by a guide projection. In doing so, the damping cylinder supporting arrangement can comprise a guide rail or a guide groove along which the guide element is guided moveably supported. Due to cooperation of the guide element with the guide rail or guide groove, a pivot position of the catch part around the second pivot axis can be predefined.

The catch part can have a first catch part projection and a second catch part projection. A catch part gap is provided between the two catch part projections. If the spider element assumes the closing position relative to the stationary element, the activating part engages in the catch part gap between the two catch part projections. The activating part can thus cooperate or get into contact with one catch part projection for moving the sliding elements in the closing direction and with the respective other catch part projection for moving the sliding element out of the closing position.

In an arrangement comprised of the sliding element, the stationary element and the above described stop position damping device, the damping cylinder supporting arrangement with the damping cylinder can either be fixed at the sliding element or at the stationary element, wherein the fixing at the sliding element is advantageous. Regularly a receiving groove that is open to the stationary element is provided there, in which the damping cylinder supporting arrangement can be arranged and attached. The activating part is fixed at the respective other element, thus, for example, at the stationary element such that a relative movement between the catch part and the activating part occurs, if the sliding element is moved in sliding direction relative to the stationary element.

BRIEF DESCRIPTION OF THE DRAWINGS

Advantageous embodiments of the invention result from the dependent claims, the specification and the drawings. Below, preferred embodiments of the invention are explained in detail with reference to the attached drawings. It shows:

DETAILED DESCRIPTION

Figure 1:
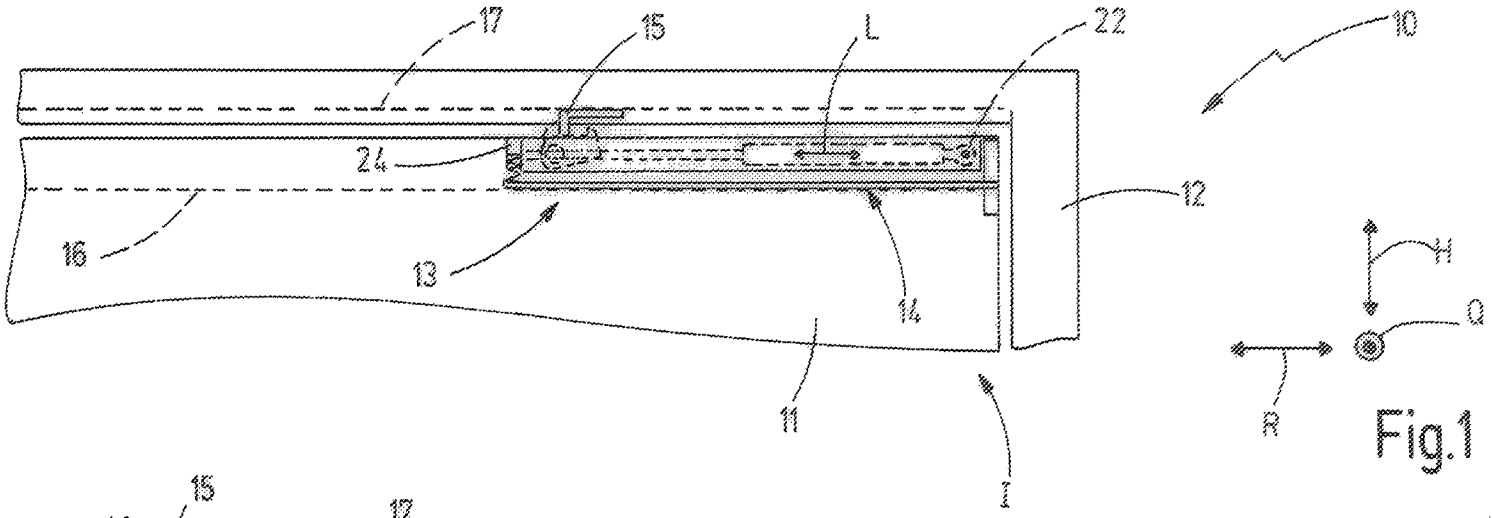
FIG. 1 a schematic side view of an arrangement of a stationary element, a sliding element and an embodiment of a stop position damping device, FIG. 2 the stop position damping device according to FIG. 1 in a schematic side view, wherein the sliding element assumes the closing position, FIG. 3 a schematic side view of the stop position damping device according to FIGS. 1 and 2 directly after an erroneous assembly, FIG. 4 a schematic side view of the stop position damping device of FIG. 3 during a first movement of the sliding element in the closing position, FIGS. 5-7 a schematic side view of the stop position damping device according to FIGS. 1-4 in different conditions during continued movement of the sliding element out of the closing position in an open position respectively, FIG. 8 a schematic basic illustration of an adjustment device for adjusting a height distance between the first pivot axis and a base carrier or a base plate of the base carrier respectively and FIG. 9 a schematic view of the stop position damping device according to FIGS. 1-7 in a view in sliding direction according to arrow IX.

FIG. 1 illustrates a schematic partial illustration of an arrangement 10 to which a sliding element 11, a stationary element 12 as well as a stop position damping device 13 belongs. According to the embodiment the stop position damping device 13 has a structural unit 14 that is attached to the sliding element 11. An activating part 15 is non-moveably attached to the stationary element 12. In modification of the illustrated embodiment, the structural unit 14 could also be attached to the stationary element 12 and the activating part 15 to the sliding element 11.

At the sliding element 11 regularly a groove-like receiving space 16 is present that is open in a height direction H to the stationary element 12. This receiving space 16 is sufficiently large in standard doors or standard windows for accommodating the structural unit 14. The activating part 15 can be attached in a fixing groove 17 that is open in height direction toward the sliding element 11. At least a portion of the activating part 15 may extend out of the fixing groove 17 toward the sliding element 11 in the installation position.

Figure 2:
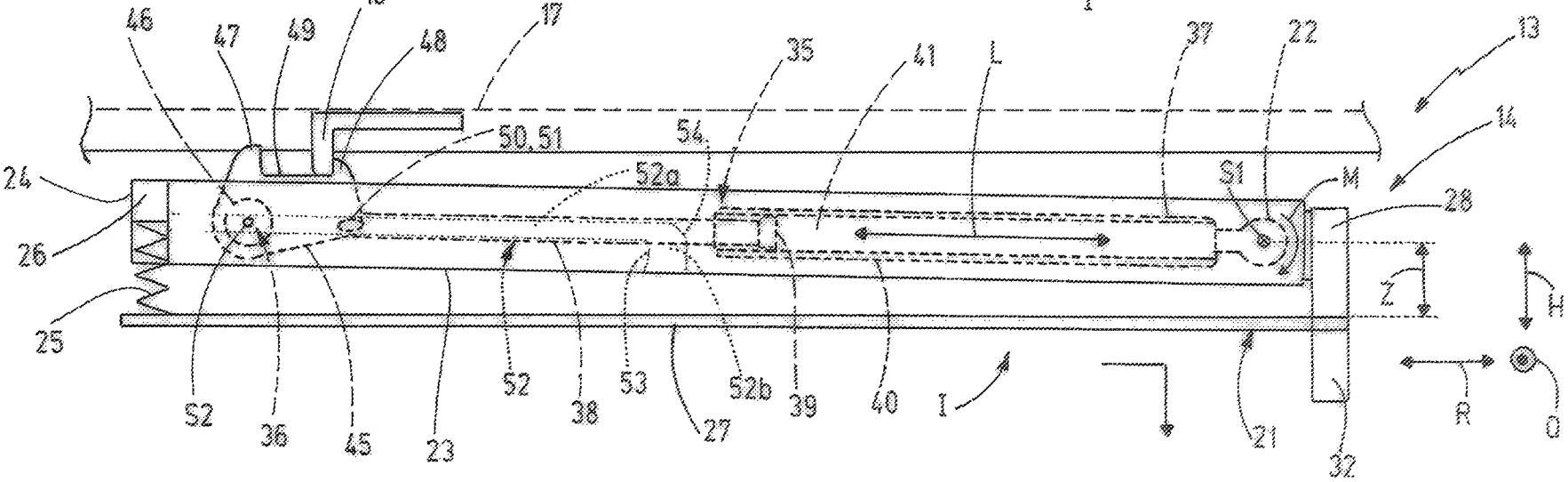

The sliding element 11 is slidably supported relative to the stationary element 11 in a sliding direction R. The sliding element 11 can be a wing of a door or a window, for example. In FIGS. 1 and 2 a closing position I of the sliding element 11 in relation to the stationary element 12 is illustrated respectively.

A Cartesian coordinate system that is stationary relative to the stationary element 12 is defined by the sliding direction R, a transverse direction Q and a height direction H. The height direction H may be oriented substantially vertically. In the embodiment the sliding direction R extends in a horizontal direction. Depending on the installation position of the stationary element 12, a different orientation of the Cartesian coordinate system H, Q, R relative to the vertical or horizontal can occur.

FIGS. 2 to 7 and 9 schematically illustrate an embodiment of the stop position damping device 13. A basic carrier 21 belongs to the structural unit 14 at which a damping cylinder supporting arrangement 23 is pivotably mounted around a first pivot axis S1 by means of a first pivot bearing 22. The first pivot axis S1 extends perpendicular to the sliding direction R and perpendicular to the height direction H in transverse direction Q. The first pivot bearing 22 is present at one end of the damping cylinder supporting arrangement 23. Starting from this first pivot bearing 22, the damping cylinder supporting arrangement 23 extends in a length direction L toward an opposite free end 24. In the embodiment the damping cylinder supporting arrangement 23 can be moved only in one single degree of freedom relative to the base carrier 21, that is executing a pivot movement around the first pivot axis S1. Preferably, additional guides between the base carrier 21 and the damping cylinder supporting arrangement 23 are not present. The base carrier 21 is non-moveably attached at the sliding element 11 according to the embodiment. The length direction L is stationary relative to the damping cylinder supporting arrangement 23 and can be oriented parallel or inclined with regard to the sliding direction R depending on the pivot position around the first pivot axis S1.

At the free end 24 a biasing element 25 is present that creates a biasing force between the base carrier 21 and the damping cylinder supporting arrangement 23 and thus a torque M around the first pivot axis S1. The biasing element 25 can be formed by one or more elastically deformable bodies, for example. In the embodiment, the biasing element 25 is formed by a helical spring. According to the example, the damping cylinder supporting arrangement 23 has an end part 26 at its free end 24 that contains a receiving hole that is open toward the base carrier 21 and for example toward a base clearance 27 of the base carrier 21, into which the biasing element 25 extends partly. The biasing element 25 is supported with its respective other end at the base carrier 21 and according to the example at the base plate 27.

In the present embodiment the base plate 27 extends from the free end 24 at least to the first pivot bearing 22. At the end of the base plate 27 that is arranged adjacent to the first pivot bearing 22 a fixing part 32 can be provided that extends transverse from the base plate 27 in a direction away from the first pivot bearing 22 and is configured for fixing, for example screwing, of the base carrier 21 at the sliding element 11.

For defining the first pivot bearing 22, the base carrier 22 comprises a bearing body 28 that is attached at the base plate 27 in the present embodiment. The bearing body 28 supports the first pivot bearing 22 or defines a portion of the first pivot bearing 22. The bearing body 28 defines a height distance z between the base plate 27 and the first pivot axis S1 in height direction. This height distance z is unchangeably and constantly predefined in the preferred embodiment according to the FIGS. 1-7 and 9. In an alternative embodiment according to FIG. 8, the height distance z can be adapted to the constructive conditions at the assembly. In doing so, a respective adjustment device 29 can be present. An adjustment screw may belong to the adjustment device 29, for example, by means of which the position of a pivot bearing part 31 that defines the first pivot axis S1 may be adjusted in height direction H relative to the bearing body 28 or the base plate respectively. During operation the height distance z is unchangeable also in this alternative embodiment according to FIG. 8.

A damping cylinder 35 belongs to the stop position damping device 13. The damping cylinder 35 extends in length direction L from a first end 36 to a second end 37. The distance between the first end 36 and the second end 37 is changeable. The first end is defined by a free end of the piston rod 38, the opposite end of which is connected with a piston 39. The piston 39, together with the piston rod 38, is slidably arranged in a cylinder housing 40 of the damping cylinder 35 in length direction L. In the embodiment the piston 39 limits a working area inside the cylinder housing 40 that may be implemented as gas pressure space 41, in which a compressible gas is present. The damping cylinder 35 thus forms a gas spring or gas damping device respectively, so to speak. Other force generating means may be provided alternatively or additionally in the working area, such as a mechanical spring device.

The cylinder housing 40 is non-moveably fixed at and relative to the damping cylinder supporting arrangement 23. During a pivot movement of the damping cylinder supporting arrangement 23 around the first pivot axis S1, the damping cylinder 35 also pivots around the first pivot axis S1.

At the first end 36, that is formed at the free end of the piston rod 38, a catch part 45 is arranged. The catch part 45 is pivotably mounted at the piston rod 48 around a second pivot axis S2 by means of a second pivot bearing 46. The second pivot axis S2 extends parallel to the first pivot axis S1 in transverse direction Q. The catch part 45 has a first catch part projection 47 and a second catch part projection 48. The two catch part projections 47, 48 are arranged with distance to each other in length direction L and limit a catch part gap 49 in between. Thus, the catch part 45 has with view in transverse direction Q mainly a U-shaped section in the region of the two catch part projections 47, 48. The second catch part projection 48, that is arranged between the first catch part projection 47 and the cylinder housing 40, extends less far in direction toward the activating part 15 compared with the first catch part projection 47. A reference plane that is spanned by the transverse direction Q and the length direction L and that touches the outermost end of the first catch part projection 47 is neither touched nor intersected by the second catch part projection 48.

According to the example a plane that contains the second pivot axis S2 and that is oriented perpendicular to the length direction L intersects the first catch part projection 47 or has a smaller distance to the first catch part projection 47 as to the second catch part projection 48. The second catch part projection 48 is arranged closer to the cylinder housing 40 compared with the first catch part projection 47.

At the catch part 45 a guide element 50 is provided and according to the example a guide projection 51. The guide projection 51 extends in transverse direction Q away from the catch part 45 and engages into a guide groove 52 at the damping cylinder supporting arrangement 23.

The guide groove 52 extends along a first groove section 52*a* in length direction L. A second groove section 52*b* that adjoins the first groove section 52*a*, extends obliquely or perpendicularly to the first groove section 52*a* and extends according to the example in parallel or under an acute angle relative to the height direction H. The second groove section 52*b* forms a portion of the guide groove 52 that is arranged adjacent to the cylinder housing 40. From this second groove section 52*b* the first groove section 52*a* extends in direction towards the free end 24 of the damping cylinder supporting arrangement 23.

The guide groove 52 is limited by a lower groove flank 53 and on the opposite side by an upper groove flank 54. The upper groove flank 54 is arranged at a larger distance from the base carrier 21 and particularly the base plate 27 or closer at the activating part 15 in the first groove section 52*a* compared with the lower groove flank 53. In the second groove section 52*b* the upper groove flank 52 is arranged closer to the first pivot axis S1 or farther away from the second pivot axis S2 as the lower nut flank 53. The lower groove flank 53 extends under an acute angle relative to a plane that is oriented perpendicular to the length direction L and curves in a transition section from the first groove section 52*a* to the second groove section 52*b* about an angle that is larger than 90 degrees. In doing so, a kind of undercut extension of the first groove flank 53 is formed in the second groove section 52*b* that is produced from by an extension component perpendicular to the length direction L and an extension component in length direction L away from the free end 24 with view from the end of the groove in direction toward the first groove section 52*a*.

In the embodiment the guide projection 51 has a cross-section deviant from a circu-lar form and is for example elliptic. The guide projection 51 thus has a first cross-section dimension that is smaller than a second cross-section dimension measured perpendicular to the first cross-section dimension. The groove width of the first groove section 52*a* is at least as large as the smaller first cross-section dimension of the guide projection 51 and smaller than the second cross-section dimension of the guide projection 51. The second groove section 52*b* is at least as large as the second cross-section dimension of the guide projection 51. The groove is measured transverse to the extension direction of the guide groove 52 respectively, that is in length direction in the second groove section 52*b* and in a plane perpendicular to the length direction L in the first groove section 52*a*.

With reference to the FIGS. 2-7 the function of the stop position damping device 13 is explained below.

Figure 7:
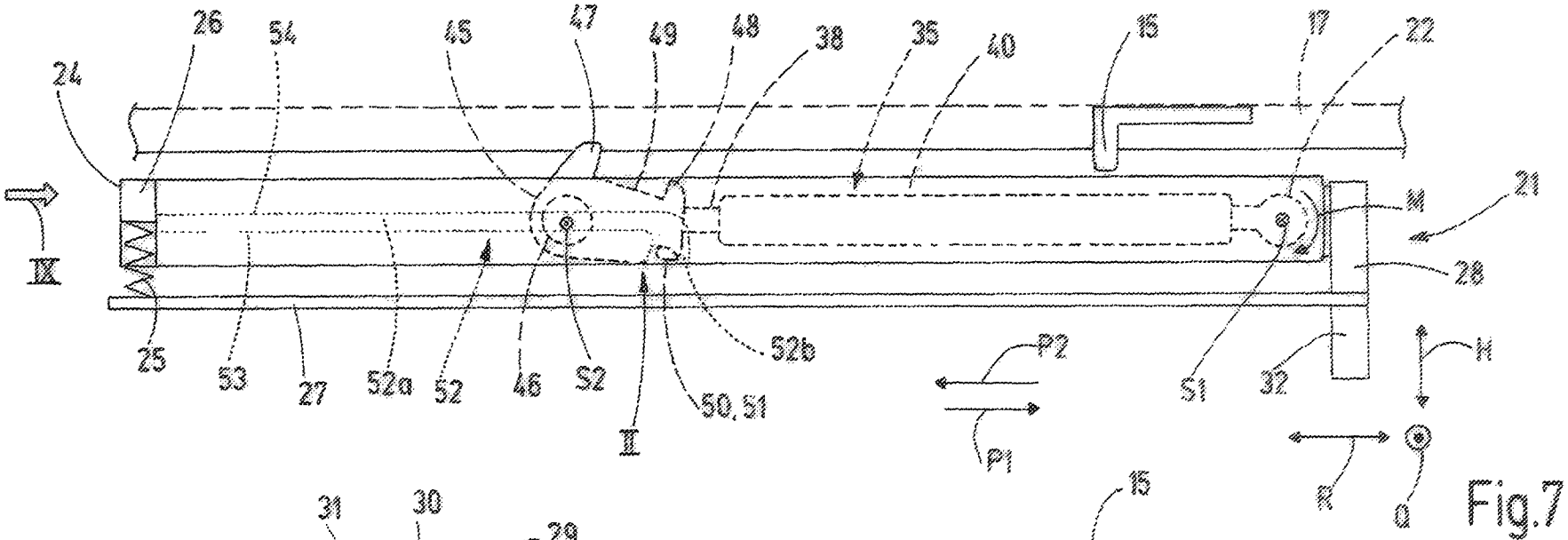
in FIG. 7.
Figure 9:
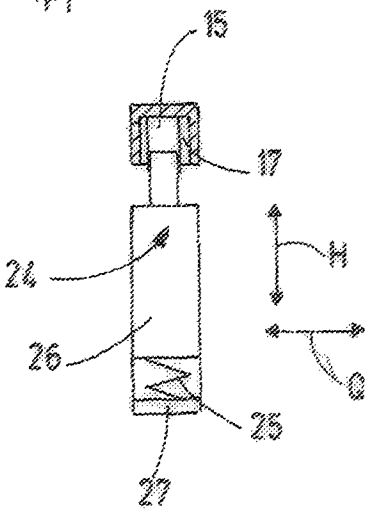
Figure 8:
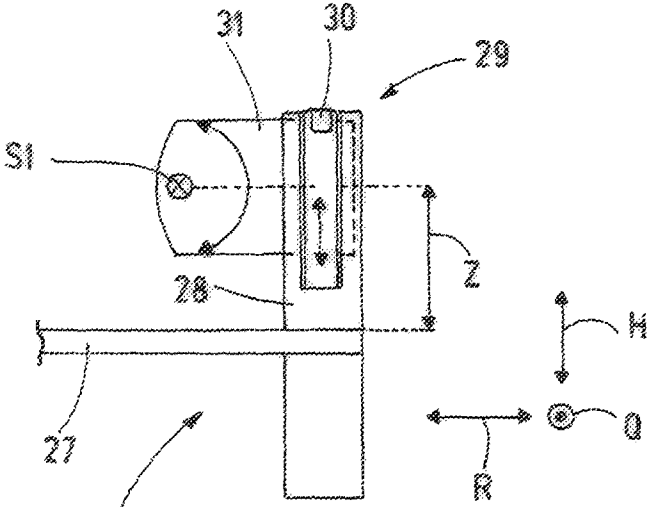

Provided a correct assembly, the damping cylinder 35 is brought into a tensioned position II, as illustrated by way of example in FIG. 7. In doing so, the piston rod 38 is inserted and the guide projection 51 is present in the second groove section 52*b*. In the tensioned position II the catch part 45 has a position, in which the activating part 15 can be moved without collision between the two catch part projections 47, 48 in the catch part gap 49. The catch part 45 is kept in the tensioned position II, because in the gas pressure space 41 a force is applied onto the piston 39 that urges the piston rod 38 in direction towards the extended position. Because of the force that acts on the piston rod 38 in the tensioned po-sition II, the guide projection 51 is urged against the lower groove flank 53. The lower groove flank 53 forms a kind of undercut. In doing so, the catch part 45 remains in its ten-sioned position as long as it is not moved out of the tensioned position by means of the activating part 45.

Figure 3:
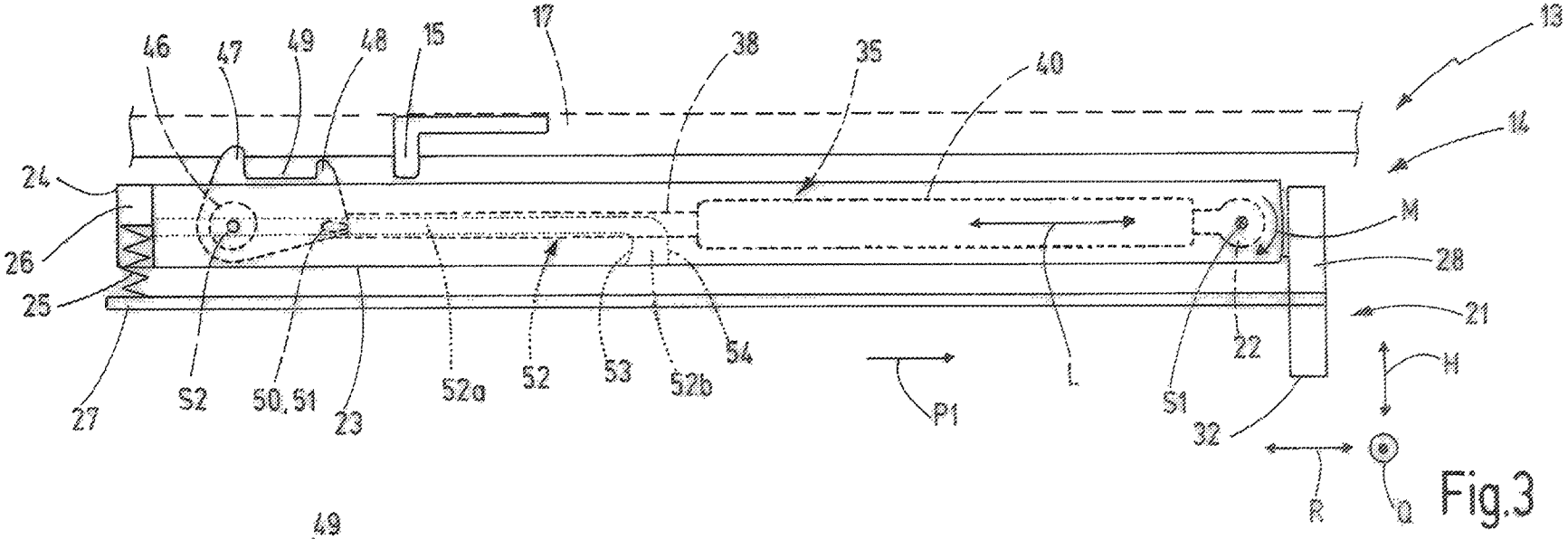
Figure 4:
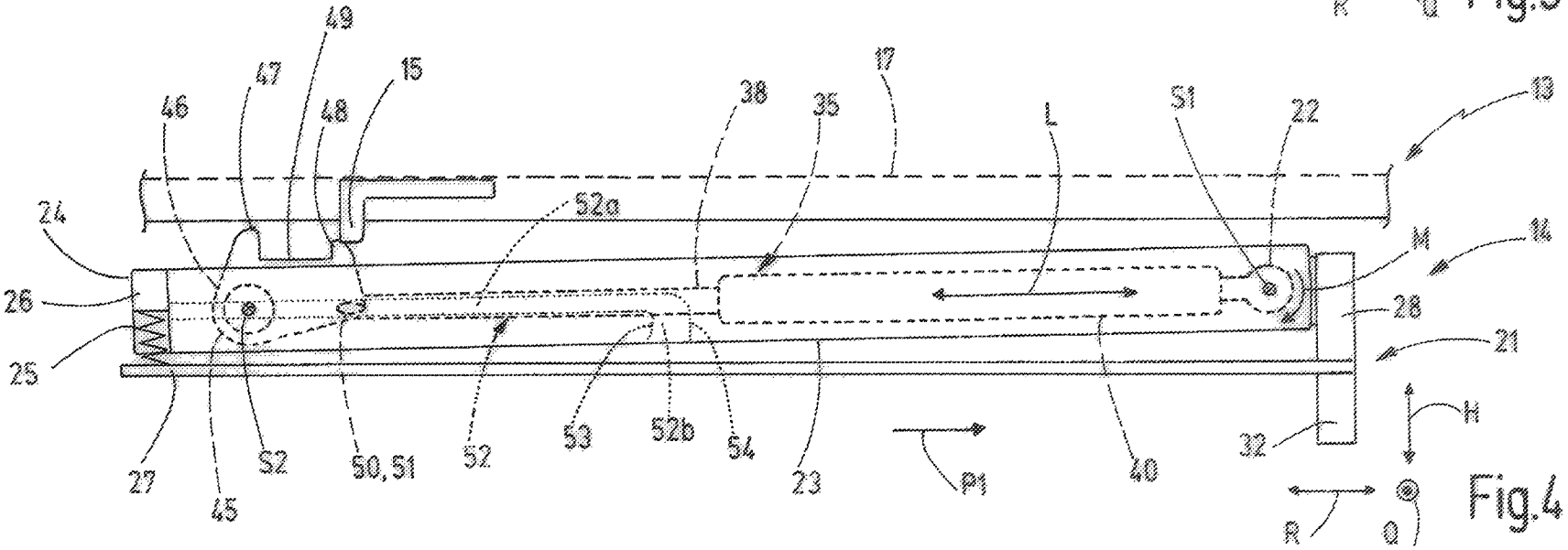

FIG. 3 shows a situation after assembly in which the activating part 15 was erroneously not brought into the tensioned position II. The second catch part projection 48 is in a pivot position around the second pivot axis S2, in which the activating part 15 cannot move past the second catch part projection 48 into the catch part gap 49 without collision. A pivot movement of the catch part 45 around the second pivot axis S2 is impossible, be-cause the first guide projection 51 is outside the tensioned position II in the first groove section 52*a* and blocks pivoting of the catch part 45 around the second pivot axis S2. Start-ing from this erroneous assembly, if the sliding element is moved in sliding direction R in direction toward the closing position I (according to the first arrow P1 in FIG. 3) a colli-sion between the activating part 15 and the catch part 45 and, according to the example, the second catch part projection 48 occurs. This situation is illustrated in FIG. 4. Because of the pivot mobility of the damping cylinder supporting arrangement 23 around the first pivot axis S1, the damping cylinder supporting arrangement 23 is pivoted against the force of the biasing element 25 away from the activating part 15 towards the base carrier 21 or the base plate 27 respectively upon contact between the activating part 15 and the catch part 45, such that the activating part 15 can pass into the catch part gap 49. A damage of the catch part 45 is avoided.

Out off the tensioned position II of the catch part 45 the activating part 15 engages between the two catch part projections 47, 48 into the catch part gap after error-free assembly or after error remedy as described above, which is illustrated exemplarily in FIG. 5. During a movement of the sliding element 12 together with the structural unit 14 from the closing position of the sliding element 11 away (in direction of an error P2 parallel to the sliding direction R in FIG. 5) the activating part 15 is in contact with the second catch part projection 48 and pushes the piston rod 48 into the cylinder housing 40. In doing so, a force builds up inside the damping cylinder 35 or in the gas pressure space 41 respectively that urges the piston rod 48 in its extended position.

Figure 6:
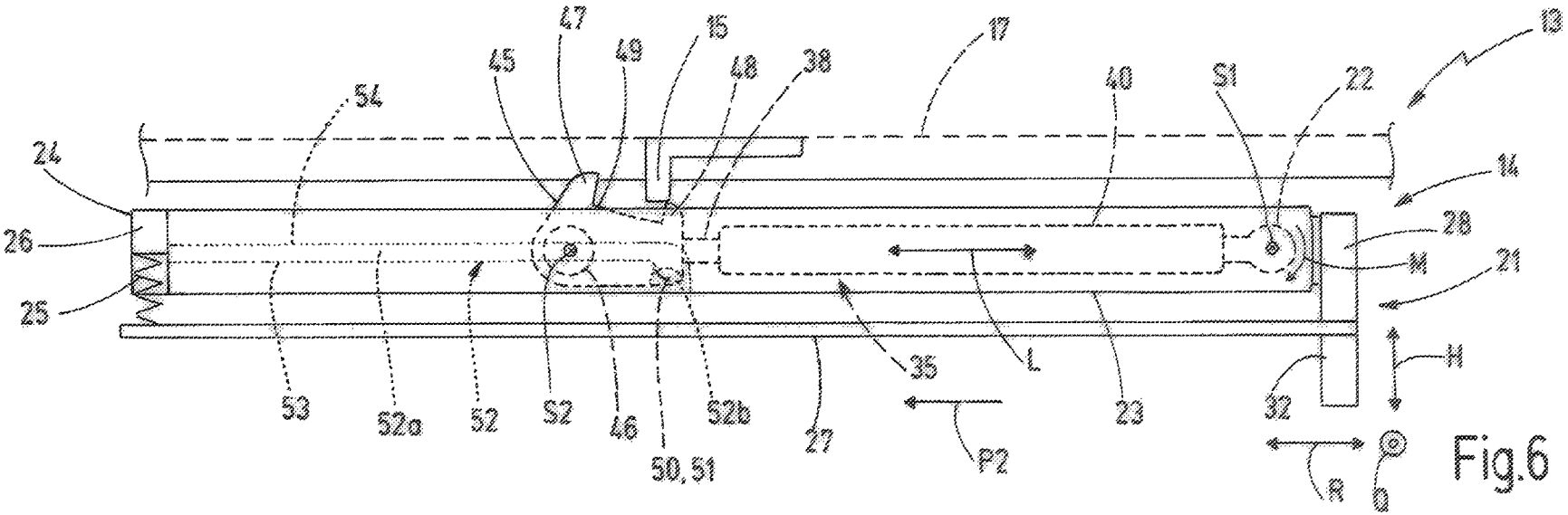

During this retracting movement of the piston rod 38 the guiding projection 51 moves initially in length direction L in the first groove section 52*a* and transverse to the length direction L as soon as it reaches the second groove section 52*b* and the catch part 45 executes a pivot movement around the second pivot axis S2 (FIG. 6). The second catch part projection 48 opens the catch part gap 49, such that the activating part 15 is released from the catch part gap 49 as soon as the catch part 45 was pivoted around the second pivot axis S2 in its tensioned position II. In this tensioned position the sliding element 11 can be moved in the direction of the second arrow P2 arbitrarily far away from the closing position in an open position (FIG. 7).

As soon as the activating part 15 was moved out of the catch part gap 49 it moves relative to the structural unit 14 without contact. It has to be noted here, that during a movement of the sliding element 11 in sliding direction R only a contact between the activating part 15 and the catch part 45 may occur. Other contact locations, particularly frictional bearing locations or roller bearing locations, between the structural unit 14 and the activating part 15 or the element 11, 12 at which the activating part 15 is mounted, are not present.

Figure 5:
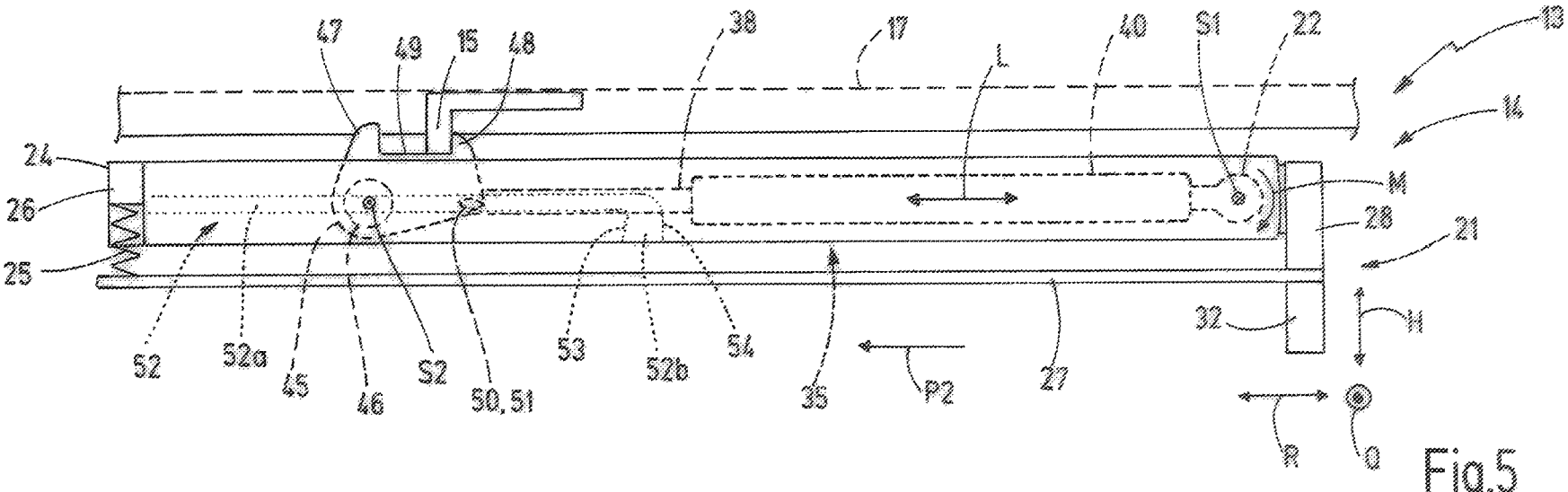

If the sliding element 11 is moved back in direction of the first arrow P1 in the closing position I, the conditions illustrated in FIGS. 5-7 are assumed in reverse sequence. At first, as illustrated in FIG. 6, the activating part 15 slides past the second catch part projection 48 until it abuts at the first catch part projection 47. As a consequence, a pivot movement of the catch part 45 around the second pivot axis S2 is initiated that causes the guide projection 51 to move out of the second groove section 52*b* in the first groove section 52*a*. Subsequently, the piston rod 38 is extended due to the pressure force present in the gas pressure space 41. During this extension movement, the second catch part projection 48 is supported at the activating part 15 and moves the sliding element 11 in a con-trolled manner in the closing position, as it is shown in FIG. 2. In this position, the sliding element 11 is additionally lowered in height direction H, which causes the oblique position of the length direction L with regard to the sliding direction R.

The invention refers to a stop position damping device 13 for a sliding element 11 that is slidably ranged in a sliding direction R relative to a stationary element 12. The stop position damping device 13 comprises a structural unit 14 and an activating part 15 that are connected to one of the two elements 11, 12 respectively. The structural unit 14 has a base carrier 21 at which a damping cylinder supporting arrangement 23 is pivotably mounted with one and around a first pivot axis S1. At the opposite free end 24, the damping cylinder supporting arrangement 23 is supported without guidance at the base carrier 21 by means of a biasing element 25, wherein the biasing element 25 creates a torque around the first pivot axis S1. In an area that is closer to the free end 24 as to the first pivot axis S1, a catch part 45 can move in a length direction L relative to the damping cylinder supporting arrangement 23. If an unintended collision occurs between the activating part 15 and the catch part 45 due to an erroneous assembly, the damping cylinder supporting arrangement 23 with the catch part 45 can pivot away from the activating part 15.

REFERENCE SIGN LIST

10 arrangement
11 sliding element
12 stationary element
13 stop part damping device
14 structural unit
15 activating part
16 receiving space
17 fixing groove
21 base carrier
22 first pivot bearing
23 damping cylinder supporting arrangement
24 free end of the damping cylinder supporting arrangement
25 biasing element
26 end part
27 base plate
28 bearing body
29 adjustment device
30 adjustment screw
31 pivot bearing part
32 fixing part
35 damping cylinder
36 first end
37 second end
38 piston rod
39 piston
40 cylinder housing
41 gas pressure space
45 catch part
46 second pivot bearing
47 first catch part projection
48 second catch part projection
49 catch part gap
50 guide element
51 guide projection
52 guide groove
52*a* first groove section
52*b* second groove section
53 lower groove flank
54 upper groove flank
H height direction
I closing position
II tensioned position
L length direction
Q transverse direction
P1 first arrow
P2 second arrow
R sliding direction
S1 first pivot axis
S2 second pivot axis
z height distance

The invention claimed is:

1. Stop position damping device (13) for a sliding element (11) that is slidably supported in a sliding direction (R) relative to a stationary element (12), the stop position damping device (13) comprising:

a damping cylinder (35), that comprises a first end (36) and a second end (37) opposite to the first end (36), a distance between which is changeable in a length direction (L) of the damping cylinder (35), and a catch part (45) at the first end (36), a damping cylinder supporting arrangement (23), at which the damping cylinder (35) is mounted, that is connected with a base carrier (21) via a first pivot bearing (22), wherein the damping cylinder supporting arrangement (23) is pivotably supported near the second end (36) of the damping cylinder (35) around a first pivot axis (S1) extending a transverse direction (Q) perpendicular to the length direction (L), wherein the damping cylinder supporting arrangement (23) comprises a biasing element (25) at a free end (24) opposite to the first pivot bearing (22) in the length direction (L), wherein the biasing element (25) is configured to urge the free end (24) of the damping cylinder supporting arrangement (23) away from the base carrier (21) and in so doing to create a torque (M) of the damping cylinder supporting arrangement (23) around the first pivot axis (S1).

2. Stop position damping device according to claim 1, wherein the damping cylinder supporting arrangement (23) is not limited to certain degrees of freedom at the free end (24).

3. Stop position damping device according to claim 1, wherein the damping cylinder supporting arrangement (23) is only guided relative to the base carrier (21) via the first pivot bearing (22).

4. Stop position damping device according to claim 1, wherein the base carrier (21) comprises a base plate (27) that extends in the sliding direction (R) from the first end (36) to the second end (37) with distance to the damping cylinder (35) and/or the damping cylinder supporting arrangement (23).

5. Stop position damping device according to claim 4, wherein the biasing element (25) is supported at the base plate (27).

6. Stop position damping device according to claim 4, wherein the base carrier (21) comprises a bearing body (28) that is fixed at the base plate (27) and that carries the first pivot bearing (22).

7. Stop position damping device according to claim 4, wherein a height distance (z) of the first pivot axis (S1) from the base plate (27) is unchangeable during operation of the stop position damping device (13).

8. Stop position damping device according to claim 7, further comprising an adjustment means (29) configured to adjust the height distance (z).

9. Stop position damping device according to claim 1, wherein the damping cylinder (35) comprises a cylinder housing (40), a piston (39) that is slidably supported in length direction (L) inside the cylinder housing (40), and a piston rod (38) connected with the piston (39), the piston rod end of which extends from the cylinder housing (40) and forms the first end (36) of the damping cylinder (35), wherein the second end (37) of the damping cylinder (35) is formed at the cylinder housing (40).

10. Stop position damping device according to claim 9, wherein the cylinder housing (40) is non-movably held relative to the damping cylinder supporting arrangement (23).

11. Stop position damping device according to claim 9, wherein the catch part (45) is pivotably supported at the piston rod (38) around a second pivot axis (S2) that extends in transverse direction (Q).

12. Stop position damping device according to claim 11, wherein the catch part (45) comprises a guide element (50) that is arranged with distance to the second pivot axis (S2).

13. Stop position damping device according to claim 12, wherein the damping cylinder supporting arrangement (23) comprises a guide rail or a guide groove (52), along which the guide element (50) is movably arranged in a guided manner.

14. Stop position damping device according to claim 1, wherein the catch part (45) comprises a first catch part projection (47) and a second catch part projection (48) that limit a catch part gap (49).

15. Arrangement (10) of a sliding element (11), a stationary element (12) and a stop position damping device according to claim 1, wherein the sliding element (11) is slidably supported in a sliding direction (R) relative to the stationary element (12), wherein the base carrier (21) is fixed at the sliding element (11) or at the stationary element (12), and wherein an activating part (15) is fixed at the respective other element (12, 11) and is configured to cooperate with the catch part (45).

* * * * *